United States Patent [19]

Shaw

[11] Patent Number: 5,060,323

[45] Date of Patent: Oct. 29, 1991

[54] MODULAR SYSTEM FOR AUTOMATIC OPERATION OF A WATER FAUCET

[75] Inventor: Daniel C. Shaw, Geneva, Fla.

[73] Assignee: Bauer Industries, Inc., Orlando, Fla.

[21] Appl. No.: 378,924

[22] Filed: Jul. 12, 1989

[51] Int. Cl.[5] ..... E03C 1/05

[52] U.S. Cl. ..... 4/623; 4/213; 4/304; 4/406; 4/DIG. 3

[58] Field of Search ..... 4/623, DIG. 3, 304, 4/303, 305, 213, 406, 302; 251/129.04, 129.02, 129.03

[56] References Cited

U.S. PATENT DOCUMENTS

| | | | |
|---|---|---|---|
| 3,333,160 | 7/1967 | Gorski | 4/623 X |
| 3,585,683 | 6/1971 | Forbes | 4/623 |
| 3,724,001 | 4/1973 | Ichimori | 4/623 |
| 4,144,596 | 3/1979 | MacFarlane et al. | 4/DIG. 3 X |
| 4,472,010 | 9/1984 | Parnelle | 339/8 |
| 4,604,764 | 8/1986 | Enzo | 4/623 |
| 4,688,277 | 8/1987 | Kakinoki et al. | 4/623 |
| 4,762,273 | 8/1988 | Gregory | 236/93 |
| 4,823,414 | 4/1989 | Piersimoni et al. | 4/623 |

FOREIGN PATENT DOCUMENTS

| | | | |
|---|---|---|---|
| 1009724 | 6/1957 | Fed. Rep. of Germany . | |
| 2918617 | 11/1980 | Fed. Rep. of Germany | 4/623 |

OTHER PUBLICATIONS

Water-Matic Double Solenoid—Command 80 Series Brochure date: Jun. 27, 1988.

*Primary Examiner*—Henry K. Artis

*Attorney, Agent, or Firm*—Shlesinger & Myers

[57] ABSTRACT

A modular system for automatically controlling the operation of a water faucet comprises an electrically operable valve for installation in line of a water supply line to the faucet for controlling water flow to the faucet; a sensor for detecting the presence of an individual within a predetermined range of the sensor; a controller for connecting to the valve and the sensor for receiving a detection signal from the sensor and for operating the valve in response to the signal; and releasable connectors for connecting the valve and the sensor to the controller.

20 Claims, 3 Drawing Sheets

FIG. 6
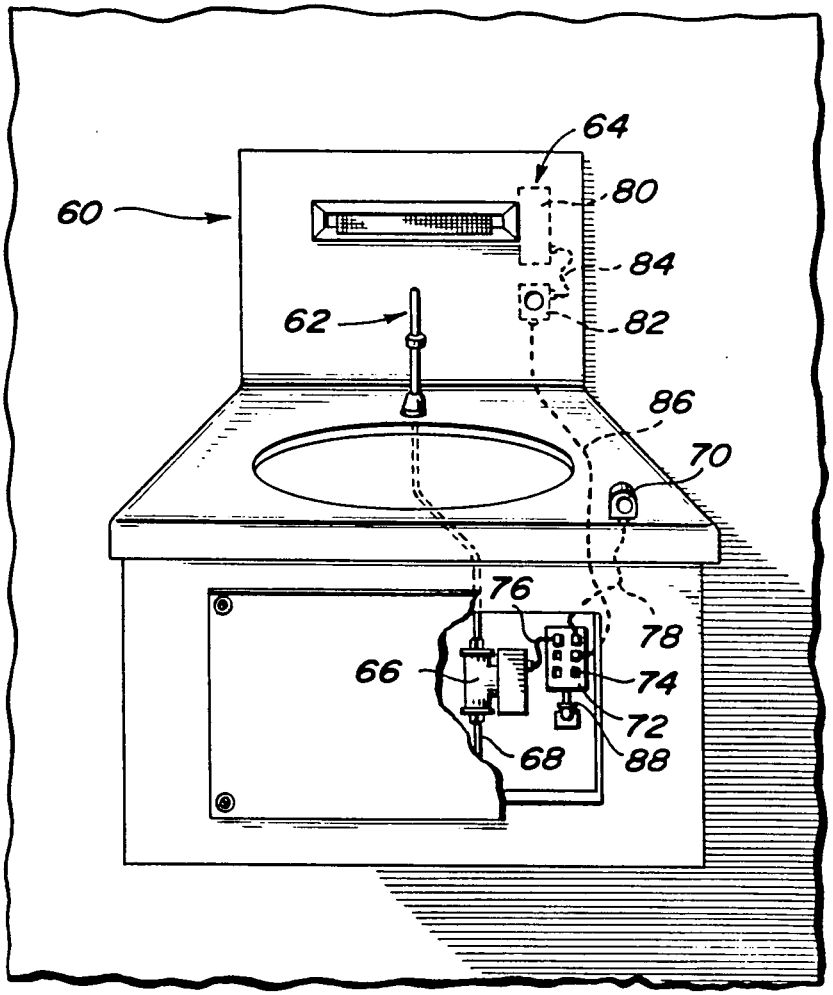
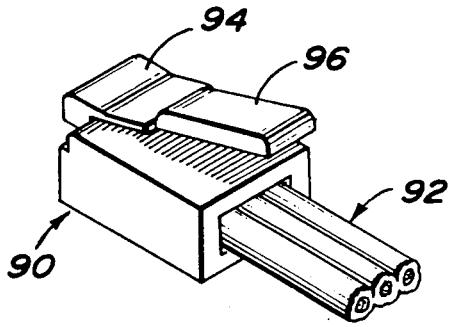
FIG. 7
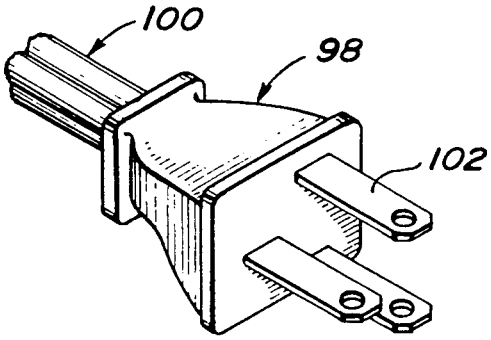
FIG. 8

MODULAR SYSTEM FOR AUTOMATIC OPERATION OF A WATER FAUCET

FIELD OF THE INVENTION

The present invention relates to automatic operation of a water faucet, and particularly to a modular system for automatic operation of a water faucet.

BACKGROUND OF THE INVENTION

The installation of a bathroom fixture, such as a sink and a faucet, is normally a job for a plumber. However, if the faucet is electrically operated by a system comprising a solenoid valve, a sensor responsive to the infra-red radiation of a person, and a control means, then an electrician would be needed to install the electrical components of the system, thereby resulting in increased cost and time which are normally not incurred in a standard sink and faucet installation. Typically, the plumber would perform the traditional plumber's tasks, such as setting the sink, connecting it to a waste line, connecting the faucet to a supply line and installing the plumbing side of the solenoid valve in the supply line. The electrician would perform the traditional electrician's work which includes wiring up a control box, and connecting the electrical side of the solenoid valve and the sensor to the control box.

Aside from the added expense of an electrician, the present division of work among the various trades make for some inefficiency in completing a job. For instance, after a plumber has completed his work, it may take an electrician some time before he can perform his part of the work if he happens to be occupied with another job when the plumber finishes his work. A delay in completing the job is therefore incurred.

If one of the components of the system, such as the solenoid valve, should fail, then the plumber would require the electrician to disconnect the power supply and, after installing the new unit in the water line, would again need the electrician to hook up the electrical portion of the valve to the control box. Thus, the added cost of an electrician is involved in doing the replacement job. If the electrician is not immediately available, a delay is added to an otherwise simple job.

In view of the foregoing, there is therefore a need for a modular system, a substantial portion of which can be installed by a plumber and which requires minimum work from an electrician, thereby reducing the cost and time incurred in the installation of the system or in the replacement of some of its components.

OBJECTS AND SUMMARY OF THE INVENTION

It is an object of the present invention to provide a modular system for an electrically controlled plumbing fixture, which requires relatively less amount of work of an electrician during installation and replacement.

It is another object of the present invention to provide a modular system for an electrically controlled plumbing fixture, a majority of whose components can be installed or replaced by a plumber with relatively minimum amount of services from an electrician.

It is still another object of the present invention to provide a modular system for an electrically controlled plumbing fixture whose components can be replaced with relative ease.

It yet another object of the present invention to provide a modular system for an electrically controlled plumbing fixture whose components are interconnected to each other by attachment plug and receptacle outlet assemblies.

It is an object of the present invention to reduce the costs and time of installing an electrically operated plumbing fixture.

It is also an object of the present invention to provide various components of an electrically operated plumbing fixture which have means to assure proper polarity of the electrical elements.

It is still an object of the present invention to provide relative ease in hooking up additional components to an existing system which operates from a common control box without the need for an electrician.

It is yet an object of the present invention to provide relative safety in installing an electrically controlled bathroom fixture so that even a non-electrician can install it.

In summary, a modular system for automatically controlling the operation of a water faucet comprises an electrically operable valve means for installation in line of a water supply line to the faucet for controlling water flow to the faucet; sensor means for detecting the presence of an individual within a predetermined range, of the sensor means; control means for connection with the valve means and the sensor means for receiving a detection signal from the sensor means and for operating the valve means in response to the signal; and releasable connector means for connecting the valve means and the sensor means to the control means.

A bathroom assembly, comprises a sink; a water faucet associated with the sink; a water supply line operably associated with the faucet; an electrically operable valve means disposed in the water supply line for controlling water flow to the faucet; first sensor means disposed adjacent the sink and faucet for detecting the presence of an individual within a predetermined range of the sink and faucet; control means operably associated with the valve means and the sensor means for receiving a detection signal from the sensor means and for operating the valve means in response to the signal; and first releasable connector means for connecting the valve means and the sensor means to the control means.

A modular system for automatically controlling the operation of a water faucet comprises a solenoid valve for installation in line of a water supply line to the faucet for electrically controlling water flow to the faucet; an infra-red sensor means for detecting the presence of an individual within a predetermined range of the sensor means; control means for connection with the valve means and the sensor means for receiving a detection signal from the sensor means and for operating the valve means in response to the signal; and releasable connector means for connecting the valve means and the sensor means to the control means.

A method for automatically controlling a water faucet, comprises the steps of providing an electrically operable valve means for installation in line of a water supply line to the faucet for controlling water flow to the faucet; providing a sensor means for detecting the presence of an individual within a predetermined range of the sensor, means; providing a control means for connection with the valve means and the sensor means for receiving a detection signal from the sensor means and for operating the valve means in response to the signal; providing releasable connector means for connecting the valve means and the sensor means to the control means; and connecting the valve means and the sensor means to the control means with the connector means.

These and other objects and advantages of the present invention will be readily apparent in view of the following description and drawings of the present invention.

DESCRIPTION OF THE DRAWINGS

FIG. 6 is a front perspective view, partly broken away, of a sink, faucet and paper towel dispenser using the present invention.

FIG. 7 is a fragmentary perspective view of a cord secured to a modular attachment plug used in the present invention.

FIG. 8 is a fragmentary perspective view of a cord secured to a three-pronged attachment plug used in the present invention.

DETAILED DESCRIPTION OF THE INVENTION

Figure 1:
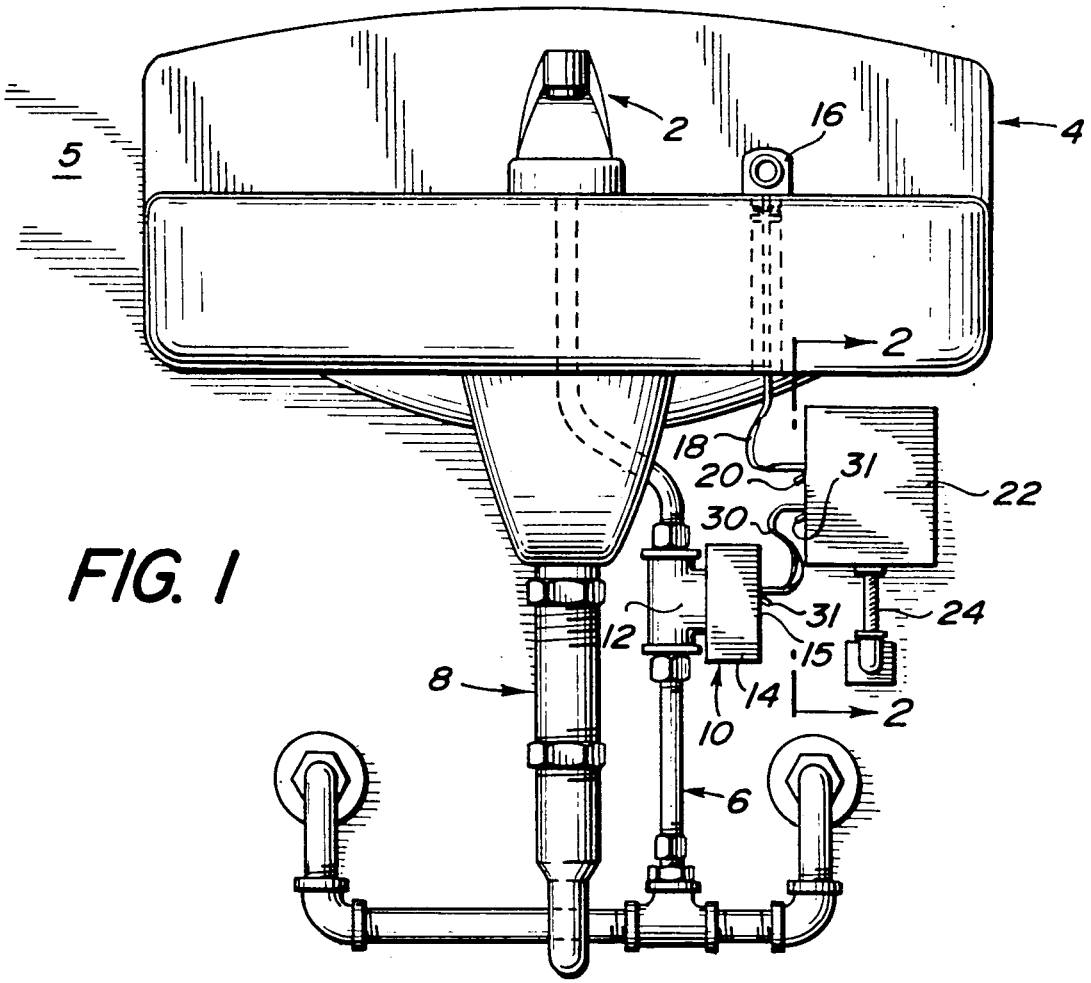
FIG. 1 is a front elevational view of a sink and a faucet using the present invention.
Figure 2:
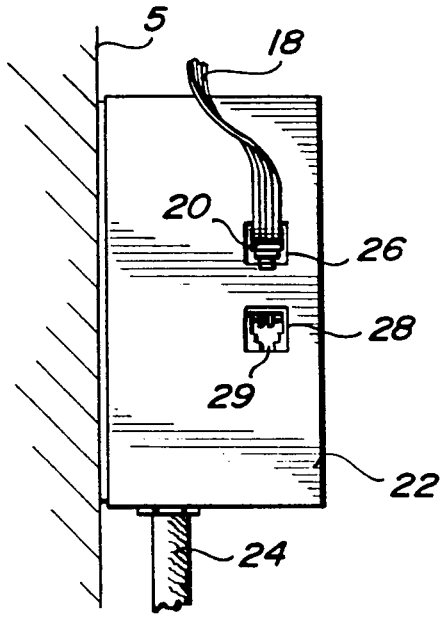
FIG. 2 is a fragmentary view taken along line 2—2 in FIG. 1, showing an enclosure with two receptacle outlets and an attachment plug connected to one receptacle outlet, both receptacle outlets being disposed through respective openings in the enclosure.

FIGS. 1 and 2

An automatic electrically operated water faucet 2 is associated with a sink 4 secured to a wall space 5, as best shown in FIG. 1. The water faucet 2 is connected to a water line 6. Waste water line 8 drains waste water from the sink 2.

An electrically operated solenoid valve 10 is connected inline of the water line 6, thereby controlling the flow of water to the faucet 2. The valve 10 includes a mechanical valve portion 12 and an electrical actuator assembly disposed within an enclosure 14. The electrical leads of the valve 10 are terminated in a receptacle outlet 15 disposed within an opening in the enclosure 14, so that the receptacle outlet is accessible from the exterior of the enclosure 14. The receptacle outlet 15 is, preferably, of the type used for grounded receptacles in the home or the type used in a telephone handset, as best shown in FIG. 2. Preferably, the solenoid valve 10 operates at 24 volts D.C. for the safety of the installer and the user and to eliminate the need for conduit.

An infra-red radiation sensor 16 is disposed adjacent the sink 4 and the faucet 2 for determining the presence of a person near the faucet 2 and who may need to use it. The sensor 16 is an active infra-red sensor and is connected to a flexible cord 18 with an attachment plug 20 at its free end. The plug 20 is, preferably, a three lead modular telephone plug, as best shown in FIG. 7.

A control means for operating the valve 10 is disposed within an enclosure 22. A power supply line 24 is connected to the control means through the enclosure 22. The input/output terminals of the control means are terminated in a pair of receptacle outlets 26 and 28 disposed within openings in the enclosure 22 so that the receptacle outlets are accessible from the exterior of the enclosure, as best shown in FIG. 2. Although two receptacle outlets are shown, more may be provided depending on the number of sensors or other components used in a particular application, as will be described below. The receptacle outlets 26 and 28 are of the same type as the receptacle outlet 15 associated with the valve 10. As will be readily evident from FIG. 2, each of the receptacle outlets includes a keyway 29 which insures that the associated attachment plug 20 will be capable of insertion only in a predetermined orientation. This assures proper polarity of the electrical components, thereby preventing the valve 10 from opening when it should be closed and vice versa.

A flexible cord 30, having attachment plugs 31, preferably similar to the plug 20, on each end thereof connects the valve 10 to the control means in enclosure 22. The attachment plugs 20 and 31 are appropriately keyed for keyway 29, and are spring loaded to facilitate locking upon insertion.

The sensor 16 is connected to the control means within the enclosure 22 by connecting the attachment plug 20 at the end of the cord 18 to the receptacle outlet 26, as best shown in FIG. 2.

The operating voltage for the control means is preferably 24 volts so that the cords 18 and 30 will not be required to be in conduit.

While the invention is disclosed for a water faucet, one skilled in the art will understand that the invention will work equally as well with any bathroom fixture requiring water flow, such as a urinal, bidet, drinking fountain, and the like.

Also, while the invention is disclosed as using a type of receptacle outlet and attachment plug commonly used for a telephone, one skilled in the art will understand that any receptacle outlet and attachment plug with means for insuring proper polarity upon being connected may be used.

Figure 3:
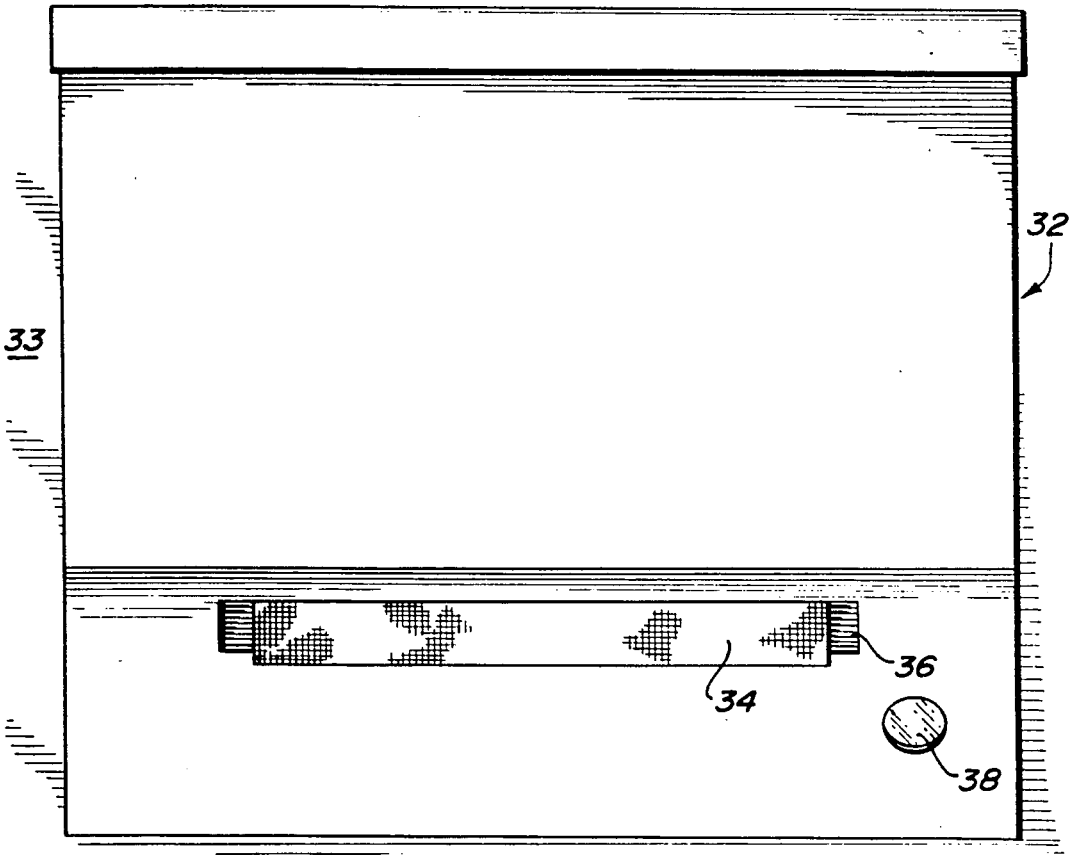
FIG. 3 is a front elevational view of a paper towel dispenser.
Figure 4:
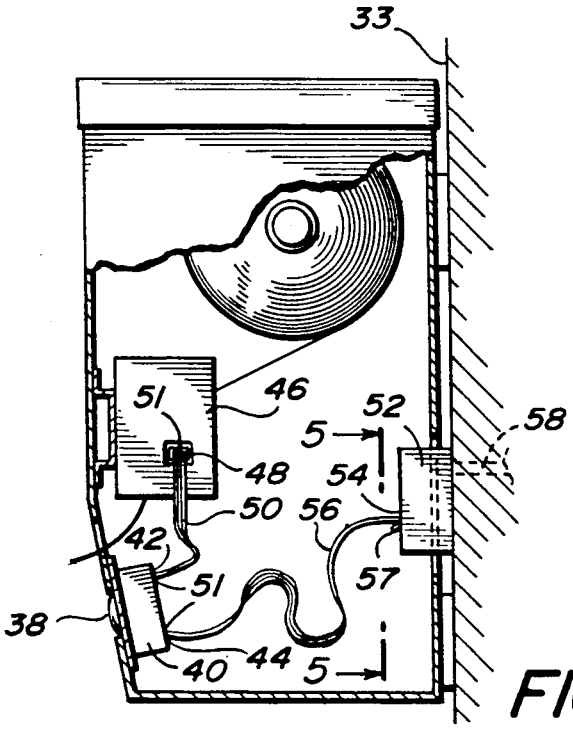
FIG. 4 is a side elevational view of the dispenser of FIG. 3, partly in cross-section and with portions broken away, showing the various components of the present invention as used in an automatic paper toweling dispenser.
Figure 5:
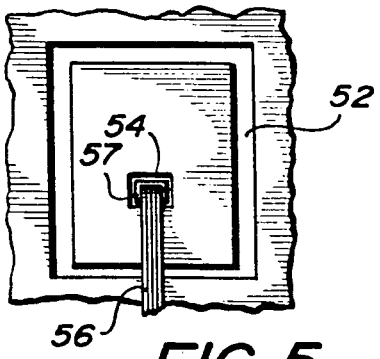
FIG. 5 is a fragmentary view taken from line 5—5 in FIG. 4, showing an enclosure with an attachment plug connected to a receptacle outlet disposed through an opening in the enclosure.

FIGS. 3, 4 and 5

An automatic electrically operated paper towel dispenser 32 which uses the present invention is shown secured to a wall 33 in FIG. 3. The dispenser 32 is fully disclosed in my pending application Serial No. 07/324,092, the disclosure of which is incorporated by reference. Paper toweling 34 is fed from the dispenser 32 through an aperture 36. An infra-red radiation sensor 38, which is of contrasted with the active passive type as the sensor 16, is disposed adjacent the paper toweling 34 within the dispenser 32. The sensor 38 is disposed within an enclosure 40. The electrical leads of the sensor 38 are terminated in receptacle outlets 42 and 44 which are disposed within respective openings in the enclosure 40. The receptacle outlets 42 and 44 are of the same type as that disclosed for the water faucet system described in the above.

An electrically operated actuator for feeding a predetermined amount of paper toweling 34 is disposed within an enclosure 46. The electrical leads of the actuator are terminated in a receptacle outlet 48 disposed within an opening in the enclosure 46. The receptacle outlet 48 is of the same type as that disclosed for the water faucet system described in the above. The operating voltage for the actuator is preferably 24 volts for safety and for simplicity in wiring.

A flexible cord 50 with an attachment plug 51 at each of its ends connects the actuator within the enclosure 46 to the sensor 38, through the actuator receptacle outlet 44 and the sensor receptacle outlet 42. The attachment plugs 51 are of the same type as disclosed for the water faucet system described in the above and are, preferably, of the type shown in FIGS. 7 and 8.

A control means is disposed within an enclosure 52 and its input/output leads are terminated in a receptacle outlet 54, as best shown in FIG. 5. A flexible cord 56 with an attachment plug 57 at each of its ends connects the receptacle outlet 48 of the sensor 38 to the receptacle outlet 54 of the control circuit. An electric supply line 58 is connected to the control circuit within the enclosure 52.

The dispenser 32 preferably operates at 24 volts so that the cords 50 and 56 will not be required to be in conduit.

FIG. 6

A bathroom fixture assembly 60 incorporating an automatic electrically operated water faucet 62 and a paper towel dispenser 64 is disclosed in FIG. 6. An electrically operated solenoid valve 66 is disposed within water line 68 for controlling the water flow to the faucet 62. Infra-red radiation sensor 70 detects the presence of a person needing to use the faucet 62. A control means within an enclosure 72 receives a detection signal from the sensor 70 and causes the valve 66 to operate. The valve 66 is provided with a receptacle outlet. The control means includes a plurality of receptacle outlets for connecting it to the valve 66 and to the sensor 70 with flexible cords 76 and 78, respectively. The cords 76 and 78 include attachment plugs at their ends for insertion into the receptacle outlets of the valve 66 and the controller enclosure 72.

An electric actuator disposed within an enclosure 80 is connected to another infra-red radiation sensor 82 by means of a flexible cord 84 with attachment plugs connected to a receptacle outlet in the enclosure 80 and to another receptacle outlet in the sensor 82. A flexible cord 86 with an attachment plug at each of its ends connects the sensor 82 by means of a receptacle outlet to the controller and by means of one of the receptacle outlets 74. A power supply line 88 connects to the control means through the enclosure 72.

The operating voltage for the bathroom fixture assembly is preferably 24 volts to eliminate the need for conduit and for safety to the installer and the user.

FIGS. 7 and 8

An attachment plug 90 similar to the type commonly used in modular telephone sets, as best shown in FIG. 7, is preferably used in the invention. Leads 92 are terminated in the plug 90. In the present application, one lead is a "hot" wire, the other one is neutral, and one is ground. The attachment plug 90 includes a key which is received in the keyway 29 of the respective receptacle outlet for assuring that the plug 90 is inserted into its receptacle outlet in a predetermined orientation for proper polarity. The key 94 includes a locking and spring portion 96 for insuring that the plug 90 stays inside its receptacle outlet, while being capable of quick removal if necessary.

Another attachment plug 98 which may be used in the present invention and which is similar to the standard three-pronged grounded plug commonly used for domestic electrical appliances is shown in FIG. 8. The plug includes electrical leads 100 which are individually terminated to each respective prongs 102. One skilled in the art will understand that the plug 98 can only be inserted into its receptacle outlet in a predetermined orientation. This feature insures that the connection made is proper and safe and polarity is as desired.

OPERATION

The operation of the invention will now be described. Although the following description is made with reference only to FIG. 1, the description applies equally well as to FIGS. 4 and 6.

A plumber hangs the sink 4 to the wall space 5 by conventional means. He then secures the faucet 2 to the sink 4. The plumbing portion 12 of the solenoid valve 12 is connected to the water line 6 which is then hooked up to the faucet 2. The waste water line 8 is connected to the sink 4.

An electrician then installs the enclosure 22 which houses the control means. The control means is then wired up to the building power supply by means of the supply line 24. The sensor 16 is installed on the sink 4 adjacent the faucet 2. The flexible cord 18 is then inserted into its respective receptacle outlet in the enclosure 22. The flexible cord 30 is plugged into the receptacle outlet in the enclosures 14 and 22, thereby connecting the valve 10 to the control means in the enclosure 22. The attachment plugs, as shown in FIGS. 7 and 8, can only be inserted into their respective receptacle outlets in a predetermined orientation, thereby insuring proper connections between the various components.

One will readily appreciate the ease of connecting the sensor 16 and the valve 10 to the control means through the use of flexible cords, attachment plugs and receptacle outlets. After the electrician has wired up the control means within the enclosure 22 to the building power, the plumber can make the hook-ups between the other components to the control enclosure. The modular feature of the invention makes for a relatively quick installation, thus effecting manhour savings.

If the solenoid valve 10 or the sensor 16 should fail, the plumber can install the replacement and avoid the need for the electrician. The modular feature of the components provided by the use of flexible cords, plugs and receptacle outlets makes the job relatively easy for a non-electrician. The plumber merely unplugs the failed unit from the control enclosure 22, removes the unit, installs the new unit, and plugs it in to the enclosure 22. An electrician need not be called for the job.

Also, the additional receptacle outlets 74 in the enclosure 72 permit the user to add components as desired, while always assuring proper polarity. For example, the roll towel dispenser need not be installed initially, but may be added at a later date. Additional components can also be added later, such as a soap dispenser. The disclosed invention, because of the modular plugs and keyed receptacle outlets, permits the user to build the system desired from component parts which are easily installed, and only installed when the electrical connections are proper.

When the system is completely installed, the sensor 16 detects the infra-red radiation given off by a person near the sink 4 and provides a signal to the control means within the enclosure 22. The control means then operates the valve 10 for permitting water to flow to the faucet 2. After a predetermined period of time, the control means again operates the valve 10 to shut off the flow of water.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention or the limits of the appended claims.

I claim:

1. A modular system for automatically controlling the operation of a water dispensing fixture, comprising:

a) electrically operable valve means having an operating voltage eliminating the need for conduit while enhancing safety to the installer and user for installation in line of a water supply line to the fixture for controlling water flow to the fixture, said valve means including a connector means;

b) sensor means for detecting the presence of an individual within a predetermined range of said sensor means;

c) control means for connection with said valve means and said sensor means for receiving a detection signal from said sensor means and for causing said valve means to operate in response to the detection signal, and said control means including a plurality of connector means;

d) a first flexible cord for interconnecting said valve means to said control means, said cord having connector means at the opposite ends thereof for interconnection with cooperating ones of said connector means of said control means and said valve means;

e) each of said connector means is a plug, or a cooperating receptacle; and, f) a second flexible cord extends from said sensor means and has a connector means at the remote end thereof for interconnection with a cooperating connector means of said control means.

2. A modular system as in claim 1, wherein:

a) each of said connector means of said first flexible cord includes an attachment plug.

3. A modular system as in claim 1, wherein, a) said valve means connector means includes a receptacle;

b) said control means connector means includes at least first and second receptacles;

c) said sensor means includes a first flexible cord with an attachment plug for connecting to said first receptacle outlet of said control means; and, d) a second flexible cord includes an attachment plug on one end thereof for connecting one of said attachment plugs to said valve means receptacle outlet and for connecting the other of said attachment plugs to said second receptacle outlet of said control means.

4. A modular system as in claim 3, wherein:

a) said valve means includes an enclosure having an opening; and b) said receptacle of said valve means is disposed within said opening so that said receptacle is accessible from the exterior of said enclosure.

5. A modular system as in claim 3, wherein:

a) said control means includes an enclosure with first and second openings; and b) said first and second receptacles of said control means are disposed within said first and second openings, respectively, so that each of said first and second receptacles are accessible from the exterior of said enclosure.

6. A modular system as in claim 1, wherein:

a) said attachment plugs and receptacles include means for assuring insertion in a predetermined orientation of each of said attachment plugs into a respective receptacle.

7. A modular system as in claim 1, wherein:

a) each of said plugs includes at least three leads; and b) each of said receptacles includes means for receiving said at least three leads.

8. A modular system as in claim 3, wherein:

a) each of said plugs has a key; and b) each of said receptacles has a keyway for receiving said key.

9. A bathroom assembly, comprising:

a) a sink;

b) a water faucet operably associated with said sink;

c) a water supply line operably associated with said faucet;

d) electrically operable valve means having an operating voltage eliminating the need for conduit while enhancing safety to the installer and user disposed in said water supply line for controlling water flow to said faucet, said valve means including a connector means;

e) first sensor means disposed adjacent said sink and said faucet for detecting the presence of an individual within a predetermined range of said sink and faucet;

f) control means operably associated with said valve means and said sensor means for receiving a detection signal from said sensor means and for causing said valve means to operate in response to the signal, said control means including a plurality of connector means;

g) a first flexible cord for interconnecting said valve means to said control means, said first flexible cord having connector means at the opposite ends thereof for interconnection with cooperating ones of said connector means of said control means and said valve means;

h) each of said connector means is a plug or a cooperating receptacle; and, i) a second flexible cord extends from said sensor means and has a connector means at the remote end thereof for interconnection with a cooperating connector means of said control means.

10. A bathroom assembly as in claim 9, wherein:

a) each of said connector means of said first flexible plug includes an attachment plug.

11. A bathroom assembly as in claim 9, wherein:

a) said valve means connector means includes a receptacle; and, b) said control means connector means includes at least first and second receptacles.

12. A bathroom assembly as in claim 11, wherein:

a) said valve means includes an enclosure with an opening; and b) said receptacle of said valve means is disposed within said opening so that said receptacle is accessible from the exterior of said enclosure.

13. A bathroom assembly as in claim 11, wherein:

a) said control means includes an enclosure with first and second openings; and b) said first and second receptacle outlets of said control means are disposed within said first and second openings, respectively, so that each of said first and second receptacle outlets are accessible from the exterior of said enclosure.

14. A bathroom assembly as in claim 11, wherein:

a) said attachment plugs and receptacle include includes means for assuring insertion in a predetermined orientation of each of said attachment plugs into a respective receptacles.

15. A bathroom assembly as in claim 11, wherein:

a) each of said plugs includes at least three leads; and b) each of said receptacles includes means for receiving said at least three leads.

16. A bathroom assembly as in claim 11, wherein:

a) each of said plugs has a key; and b) each of said receptacles has a keyway for receiving said key.

17. A bathroom assembly as in claim 11, and including:

a) a dispenser means for roll toweling.

18. A bathroom assembly as in claim 17, wherein:

a) said dispenser means includes a second sensor means for detecting the presence of an individual within a predetermined range of said sensor means; and, b) connector means are operably associated with said dispenser means and said second sensor means for connecting said dispenser means and said second sensor means to said control means.

19. A modular system for automatically controlling the operation of a water faucet, comprising:

a) a solenoid valve having an operating voltage eliminating the need for conduit while enhancing safety to the installer and user for installation in-line of a water supply line to the faucet for electrically controlling water flow to the faucet, said valve including a connector means;

b) infrared sensor means for detecting the presence of an individual within a predetermined range of said sensor means;

c) control means for connecting to said valve and said sensor means for receiving a detection signal form said sensor means and for causing said valve to operate in response to the signal, said control means including a plurality of connector means;

d) a first flexible cord for interconnecting said valve to said control means, said cord having connector means at the opposite end thereof for interconnection with cooperating ones of said connector means of said control means and said valve;

e) each of said connector means is a plug, or a cooperating receptacle; and, f) a second flexible cord extends from said sensor means and has a connector means at the remote end thereof for interconnection with a cooperating connector means of said control means.

20. A modular system as in claim 19, wherein:

a) said valve includes a receptacle; and, b) said control means includes at least first and second receptacles.

* * * * *